United States Patent [19]

Coffield, Jr. et al.

[11] 4,126,955

[45] Nov. 28, 1978

[54] HIGH VELOCITY TAPERED BORE GUN AND AMMUNITION

[75] Inventors: George G. Coffield, Jr., Pleasant Valley; Dennis L. Beug, Davenport, both of Iowa

[73] Assignee: The United States of America as represented by the Secretary of the Army, Washington, D.C.

[21] Appl. No.: 778,416

[22] Filed: Mar. 17, 1977

[51] Int. Cl.[2] ..... F41C 21/00

[52] U.S. Cl. ..... 42/78; 89/14 SB; 102/38 R; 102/93

[58] Field of Search ..... 42/76 R, 78, 79; 89/7, 89/8, 14 R, 14 SB; 102/38 RA, 38 LP, 92.4, 93

[56] References Cited

U.S. PATENT DOCUMENTS

| | | | |
|---|---|---|---|
| 3,011,404 | 12/1961 | Russell | 102/93 |
| 3,400,661 | 9/1968 | Coon et al. | 89/14 SB |
| 3,412,681 | 11/1968 | Schirneker | 102/92.4 |
| 3,450,050 | 6/1969 | Robinson | 102/92.4 |
| 3,527,137 | 9/1970 | Scanlon | 89/14 R |
| 3,680,485 | 8/1972 | Zaid et al. | 102/92.4 |
| 3,948,184 | 4/1976 | Pierre et al. | 102/93 |

FOREIGN PATENT DOCUMENTS

| | | | |
|---|---|---|---|
| 521,388 | 5/1940 | United Kingdom | 42/76 |

*Primary Examiner*—Stephen C. Bentley
*Attorney, Agent, or Firm*—Nathan Edelberg; Robert O. Richardson

[57] ABSTRACT

A high velocity gun and ammunition wherein the projectile is encased in a deformable material which is squeezed in the tapered bore of the gun to more efficiently utilize expansion gases for accelerating the projectile.

6 Claims, 6 Drawing Figures

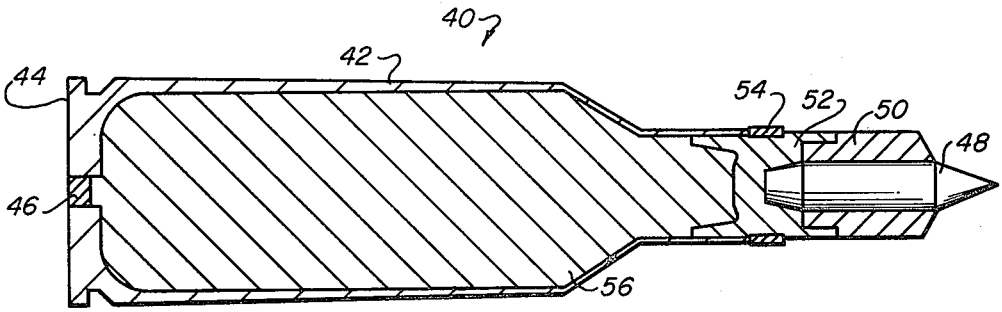
FIG. 4
FIG. 5
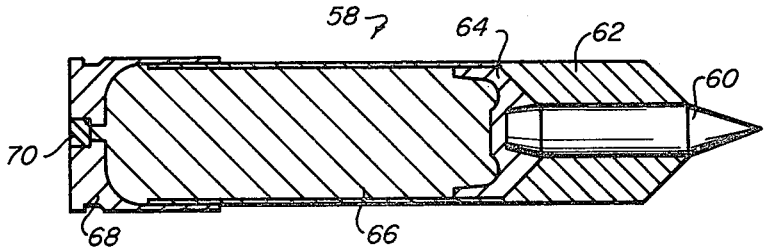
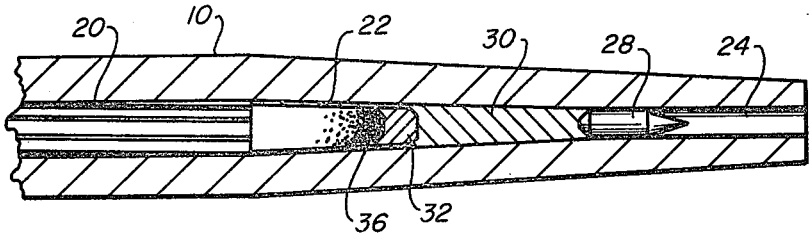
FIG. 6

HIGH VELOCITY TAPERED BORE GUN AND AMMUNITION

GOVERNMENT RIGHTS

The invention described herein may be manufactured and/or used by or for the Government for governmental purposes without the payment of any royalty thereon.

BACKGROUND OF THE PRESENT INVENTION

In the improvement of weapon systems, emphasis is placed on increased efficiency in using propellant energy and thus achieving higher projectile velocities. Reduced time of flight of the projectile, improved accuracy, and improved terminal ballistics can be obtained through higher velocity. A practical advanced weapon system concept dictates that consideration be given to weapon and ammunition cost, size, weight, and improved performance.

Today's state-of-the-art weapons have evolved from using a straight cased configuration, utilizing fast-burning black powder, to a bottleneck case, employing slower burning, higher pressure, smokeless propellants. Configurations which have been at least partially successful in the development stages are: folded rounds, which further utilize the bottleneck principle in providing a combustion chamber aside from the bore centerline; telescoped rounds; liquid propellant configurations; consolidated propellants; and various configurations utilizing programmed propellant. Characteristically, all of these gun systems have exhibited disproportional peak chamber pressure increases to muzzle velocity increases. The mass relationship of launched mass and propellant tends to get out of hand, amplifying the peak pressure problems, when velocities exceeding 5000 feet per second (fps) are desired. The increased quantity of propellant required to impart higher energies to the projectile produces a larger mass of gas, which must also be accelerated. Since a large part of the propellant is ignited in the chamber, the pressure rise is rapid, and the major part of the velocity is developed early in the innerballistic function. The projectile displacement establishes high volume increase rates relative to propellant gas expansion, resulting in a rapid pressure decay. In the lower pressure environment, burn rate of remaining propellant is not adequate to sustain the higher pressure levels. The parasitic energies involved in accelerating the gas mass proportional to projectile displacement result in significantly reduced efficiency and ultimately establish a practical velocity limit. None of the previously mentioned rounds and weapon systems have satisfactorily solved the size and pressure problems associated with a practical, produceable, repeating type gun system for velocities in excess of 6000 fps.

SUMMARY OF THE PRESENT INVENTION

The present invention relates to a weapon system and ammunition for the same, to provide very high muzzle velocity while maintaining relatively low chamber pressure. The principle of the invention is to deform the encasement material or sabot and reform it between the driving pressure and the projectile itself. The desired result is to achieve additional projectile acceleration and increased propellant efficiency.

The gun tube design incorporates a tapered bore section which provides the controlled deformation of the sabot. As the projectile passes through the tapered section of the bore, the sabot is reformed in the shape of a cone. The cone increases in length to maintain its volume as it accelerates through the tapered section. The driving base area of the cone is greater than that of the driven projectile base area throughout this process. As the length of the core increases, an acceleration differential is created between the base of the cone and the projectile. This means that the projectile has a velocity and acceleration greater than that of the base of the cone. The reduced acceleration of the cone results in more of the driving force being transferred to the projectile.

Two basic cartridge configurations and combinations thereof have been utilized to demonstrate the principle addressed. The first is a traveling charge configuration in which the propellant is encapsulated by an extension of the deformable material. The other is a conventional cartridge case with a subcaliber projectile encased within the deformable material. These two types of ammunition will be discussed in detail later in the specification.

BRIEF DESCRIPTION OF DRAWINGS

FIG. 4 is a cross sectional view of another form of cartridge consisting of a conventionally cased munition with an encased projectile, FIG. 5 is a cross sectional view of a third form of cartridge which is a modification of the two previously mentioned types, and FIG. 6 is a cross sectional view showing the sabot being extruded behind the projectile in the tapered portion.

DETAILED DESCRIPTION OF A PREFERRED EMBODIMENT

Figure 1:
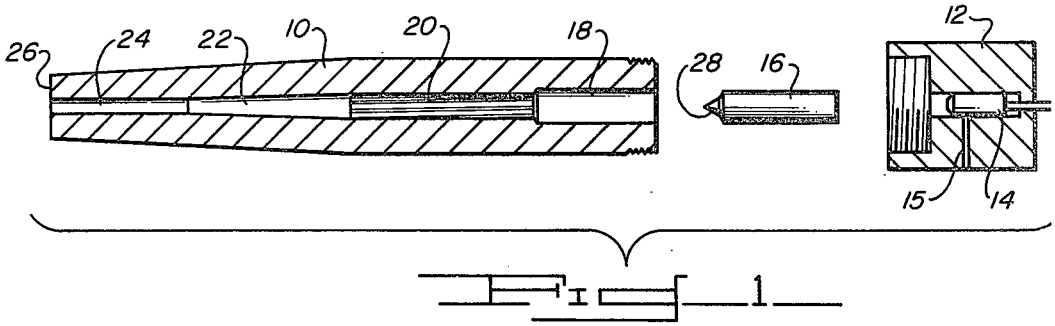
FIG. 1 is an elevational view in section of the weapon system.

Reference is made to FIG. 1 wherein there is shown a gun tube generally indicated by numeral 10. The gun tube 10 is threadably connectable with a breech section 12 which contains a detonation mechanism 14. The weapon can be ignited by a priming arrangement at the base of the munition 16 or by a detonation mechanism 14 which is an integral part of the gun. Priming systems which have been tested include electric, percussion, and catalytic. The electric and percussion systems are fairly conventional, but in the case of the catalytic system, a combustible gas is forced through catalist orifice 15 at high pressure into the gun chamber which ignites the cartridge.

As shown in FIG. 1, the bore of the gun tube 10 is functionally compatible with the innerballistics required in accelerating the projectile to be fired. A firing chamber 18 leads into a straight bore rifled section 20. The rifling terminates at the beginning of the tapered section 22. As shown, the tapered section 22 ends at a second straight bore section 24 of smaller diameter which extends to the end of the muzzle 26.

Figure 2:
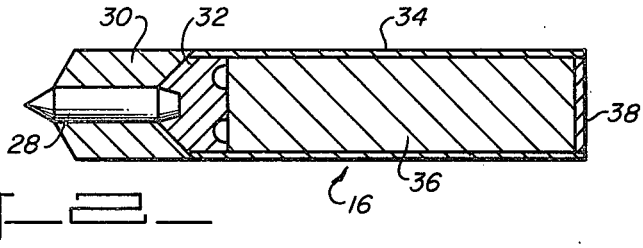
FIG. 2 is a cross sectional view of a traveling charge munition.
Figure 3:
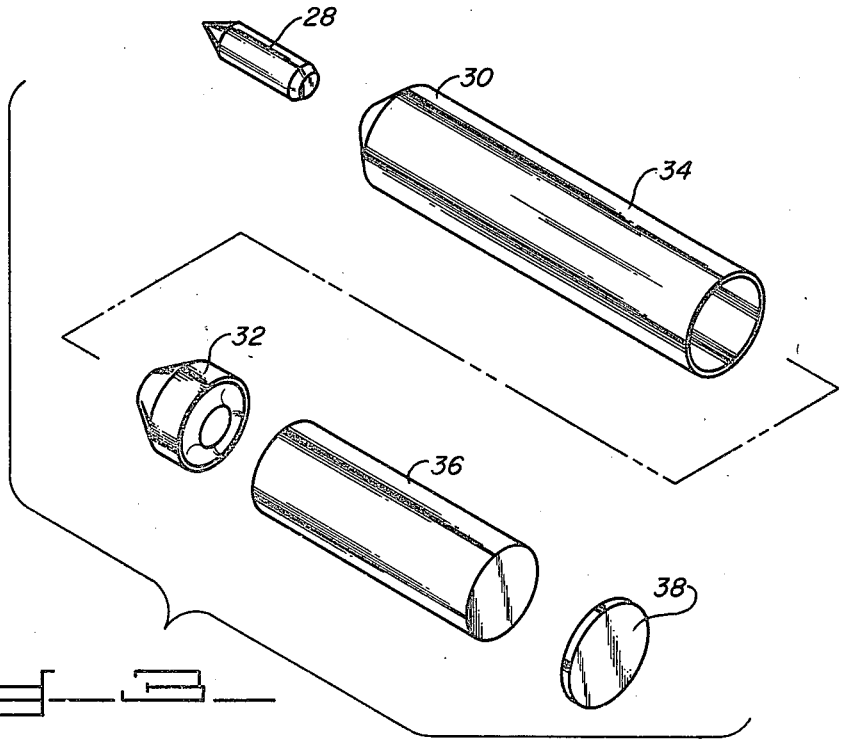
FIG. 3 is a perspective view of the components of the traveling charge munition.

In FIGS. 2 and 3, there is shown a typical traveling charge munition in accordance with the present invention. The projectile 28 is supported by and encased within a deformable material 30, such as nylon for example. Additionally supporting and positioning the projectile 28 is a pusher plate 32 which also provides structural reinforcement for the sabot during deformation. The propellant 36 is surrounded by a rearward extension 34 of the deformable material 30. The munition is sealed at the rear by a base cover 38.

In operation, the munition 16 is loaded into chamber 18, which is then closed by affixing the breech section 12. The munition is then detonated by any of the means previously discussed. A sufficient amount of the propellant 36 is initially ignited to provide the high pressure necessary during initial acceleration. Since this is a traveling charge round, the projectile 28, the sabot or deformable material 30, the pusher plate 32 and the remaining unburnt propellant 36 are accelerated through the rifled section 20 of the gun tube 10. The rifling of course imparts spin to the accelerated mass as it travels through this section of the gun tube. As the remaining propellant burns, the mass of the propelled package is reduced. Meanwhile, the volume behind the propelled package is increased as it progresses down the bore. These factors would normally tend to reduce the gas pressure; however, as the propelled package enters the tapered section 22, the base of the sabot is displaced with respect to the projectile. In other words, the deformable material 30 must elongate to maintain its original volume. This results in a reduced acceleration of the base of the deformable material while the projectile acceleration continues to increase. Also, as elongation occurs, the remaining unburnt propellant is forced into the active burn area, intensifying the propellant burn. The displaced sabot, plus the inherent area reduction of the tapered section, restrains the rate of volume increase proportional to projectile displacement. The reduced volume increase rate maintains an efficient pressure environment.

As the projectile passes through the tapered section 22, the sabot 30, pusher 32, and unburnt propellant 36 are extruded and form a column behind the projectile 28 from which it was stripped, as shown in FIG. 6. The column formed by the extruded sabot becomes a transducer between the driving gas and the projectile. The shape of the sabot column as it passes through the taper section 22 is a truncated cone, with the larger area of the base as the driving area. Since the driving area is greater than that of the projectile, and high driving pressure has been maintained, as previously discussed, very efficient projectile acceleration is obtained.

Spin rate is also enhanced through the use of the tapered bore. An angular momentum is established as the propelled package passes through the initial rifled section 20 of the bore. As the propelled mass enters the tapered section, the diameter is reduced. The mass is now concentrated closer to the center of rotation; therefore, the spin rate must increase to maintain the same angular momentum.

The final straight bore section 24 of the gun tube enhances stabilization of the projectile before launch since undesirable off axis forces may develop during the swagging in the tapered section. Also, since the projectile is launched at least the length of the swagged material column ahead of the muzzle blast, some of the influences which contribute to dispersion in conventional gum systems are eliminated. Accuracy is therefore further enhanced.

In FIG. 4, there is shown a round of ammunition 40 having a conventional casing 42. The casing 42 supporting in the base end 44 thereof a primer 46 for detonating the round. Supported at the opposite end of the casing is a saboted projectile 48 similar to that of the traveling charge munition. The sabot 50 is held in place by a forward extension of the pusher plate 52. Surrounding the pusher plate 52 is an engraving band 54 to engage the rifling and provide a gas seal during the projectile launch cycle. Contained within the casing is a combustible propellant 56.

Operation is very similar in principle to that of the traveling charge munition except that the propellant expansion occurs primarily in the gun chamber area.

In FIG. 5 there is shown a round 58 which is a modification of both the previously described types of rounds used to adapt conventional gun systems to the use of the traveling charge round. This round encorporates all of the basic parts of the traveling charge munition, as shown in FIG. 2. The projectile 60 is again surrounded by a sabot 62 followed by the pusher plate 64 and propellant 66. The round is closed by a short section of a conventional cartridge casing 68, which supports the primer 70. The round may then be detonated by the existing firing mechanism of the weapon to be used. Chamber sealing is accomplished by obturation of the casing 68. Operation from that point is identical to that of the traveling charge munition. Chamber and barrel modifications would of course be necessary to incorporate this system in conventional guns.

The invention in its broader aspects is not limited to the specific combinations, improvements and instrumentalities described but departures may be made therefrom within the scope of the accompanying claims without departing from the principles of the invention and without sacificing its chief advantages.

What is claimed is:

1. A high velocity tapered bore gun and ammunition consisting of:
   - a gun having a barrel with a chamber at one end and a muzzle section at the other,
   - said chamber having a bore of relatively larger diameter,
   - said muzzle section having a bore relatively smaller diameter,
   - said gun having a tapered bore extending between said ends,
   - an ammunition package adapted to fit into said chamber,
   - said package having a projectile of a diameter sufficient to pass through said muzzle section without deformation,
   - said projectile being encased in a deformable material of a diameter sufficient to fit into said chamber without deformation,
   - propellant means rearwardly of said deformable material which, when ignited, will expand and thus propel deformable material through said gun barrel,
   - said tapered bore reducing the diameter of said deformable material to the muzzle diameter for ejection following ejection of said projectile, said deformable material increasing in length as it reduces in diameter to maintain its original volume, said deformable material imparting additional energy and acceleration to said projectile as said deformable material elongates, said projectile having a greater velocity than that of said deformable material and said propellant.

2. A high velocity tapered bore gun and ammunition as in claim 1 wherein said gun barrel has a uniform diameter muzzle section, a rear section of uniform diameter, said tapered bore extending therebetween.

3. A high velocity tapered bore gun and ammunition as in claim 2 wherein said rear section is rifled.

4. A high velocity tapered bore gun and ammunition as in claim 1 wherein said propellant means, while burning, follows said deformable material and is itself deformed as it passes through said tapered bore.

5. A high velocity tapered bore gun and ammunition as in claim 4 wherein said ammunition package includes a cartridge casing having a primer therein.

6. A high velocity tapered bore gun and ammunition as in claim 1 wherein said ammunition package includes a cartridge casing having a primer therein.

* * * * *

UNITED STATES PATENT AND TRADEMARK OFFICE

CERTIFICATE OF CORRECTION

PATENT NO. : 4,126,955
DATED : November 28, 1978
INVENTOR(S) : George G. Coffield, Jr. et al.

It is certified that error appears in the above-identified patent and that said Letters Patent are hereby corrected as shown below:

On the cover sheet:

Item (73) Assignee should be deleted in its entirety.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*